US005654523A

United States Patent [19]

Brunn

[11] Patent Number: 5,654,523

[45] Date of Patent: Aug. 5, 1997

[54] STUN GRENADE

[75] Inventor: Michael Brunn, Sea Cliff, N.Y.

[73] Assignee: Combined Systems, Inc., Plainview, N.Y.

[21] Appl. No.: 432,678

[22] Filed: May 2, 1995

[51] Int. Cl.[6] ..... F42B 12/46; F42B 8/12

[52] U.S. Cl. ..... 102/498; 102/368; 102/482; 89/1.11

[58] Field of Search ..... 102/334, 353, 102/355, 367–370, 395, 445, 482, 498, 502, 529; 89/1.11; 446/397–400

[56] References Cited

U.S. PATENT DOCUMENTS

| | | | |
|---|---|---|---|
| 3,492,945 | 2/1970 | Filippi | 102/498 |
| 3,599,571 | 8/1971 | Richardson | 102/368 |
| 3,678,857 | 7/1972 | Evan et al. | 102/368 |
| 3,724,381 | 4/1973 | Gawlick et al. | 102/368 |
| 3,762,330 | 10/1973 | Hall | 12/487 |
| 3,795,197 | 3/1974 | Levenson | 102/368 |
| 4,932,328 | 6/1990 | Pinkney et al. | 102/482 |
| 4,976,201 | 12/1990 | Hamilton | 102/323 |
| 5,085,147 | 2/1992 | Gold et al. | 102/486 |

FOREIGN PATENT DOCUMENTS

| | | | |
|---|---|---|---|
| 705643 | 3/1965 | Canada | 102/370 |
| 572780 | 6/1924 | France | 102/482 |
| 593396 | 8/1925 | France | 102/482 |
| 158020 | 2/1940 | Germany | 102/353 |
| 1129098 | 5/1962 | Germany | 102/367 |
| WO94/08200 | 4/1994 | WIPO | 102/498 |

*Primary Examiner*—Harold J. Tudor
*Attorney, Agent, or Firm*—Cohen, Pontani, Lieberman & Pavane

[57] ABSTRACT

A stun grenade (10) for generating an explosion accompanied by light and/or blaring sound is disclosed. The stun grenade comprises a housing (12) having a body (14), a base (24) and a cover (34) defining an interior cavity (18) housing a cartridge (22) containing an explosive charge (20). A plurality of vents (30, 40) are defined in the housing (12), and a defining wall (32, 42) of each vent is angularly offset from the longitudinal axis of the cavity (18) for discharging explosive energy radially outwardly from the grenade. The stun grenade also includes a bore (25) for facilitating the releasable securement of a variety of attachments, such as a clamp (200) and a tear gas container (206).

8 Claims, 10 Drawing Sheets

STUN GRENADE

BACKGROUND OF THE INVENTION

1. Field of the Invention

This invention relates to diversionary devices for use by law enforcement or military personnel prior to entering a suspect area. More particularly, the present invention pertains to a stun grenade which produces a blaring noise accompanied by a brilliant light upon detonation of an explosive charge contained therein, for distracting suspects as law enforcement personnel enter a potential crime area. Most particularly, the present invention is directed to a non-reusable stun grenade incorporating a novel discharge port configuration for safe operation thereof.

2. Background Art

Stun grenades are primarily used by law enforcement personnel as a means of surprising criminal suspects prior to apprehension. When used, stun grenades emit a blaring noise usually accompanied by a temporarily blinding flash of light which surprises or stuns the intended suspects, thereby allowing their safe apprehension. Stun grenades are usually thrown through a window or door of a crime location, such as a room in a house, etc., to temporarily distract the occupants for a time sufficient to enable the law enforcement personnel to safely enter the location and obtain custody of the suspects.

It is desirable that stun grenades be designed in a manner which causes minimal or no permanent damage to the persons against whom the grenades are used. In addition it is desirable that such stun grenades are safe for use by law enforcement personnel.

Prior art stun grenades primarily fall within three categories. The first is ejecting munitions type stun grenades which contain single or multiple charges that are ejected from a body or canister and then ignited. A principal drawback associated with ejecting munitions type grenades is that they can become high velocity projectiles if the ejection side is blocked by a wall, floor or object, with the potential to cause severe injury to anyone in the projectile path. Also, these devices are known to cause fires, with consequent damage to potential crime scenes. In addition, these grenades may detonate in a user's hand if the ejection sequence fails.

A second category of prior art stun grenades is grenades that are comprised of a body constructed from non-resilient material. Such prior art stun grenades are problematic in that the body may shatter upon detonation, thereby propelling fragments and the fuse at high velocities.

A third type of prior art stun grenades is the reloadable type which allows for reuse of the grenade housing after detonation, typically by unscrewing the top or bottom of the grenade housing, inserting a new explosive cartridge and attaching a fuse thereto. Reusable prior art stun grenades traditionally incorporate ports or holes located on the top and/or bottom of the grenade housing to vent the explosive force generated upon detonation, thus alleviating some of the force or pressure applied to the inside walls of the housing.

One such reloadable type stun grenade is disclosed in U.S. Pat. No. 4,932,328 in which the grenade incorporates relief holes on the top and bottom to direct the explosive force in a direction parallel to the longitudinal axis of the grenade housing. However, when such a stun grenade is thrown through a door or window, due to the cylindrical shape of the housing the grenade may roll into a corner such that the pressure relief ports on the top and/or bottom of the housing are partially or substantially obstructed. In such event, upon detonation the grenade will become a high velocity projectile capable of causing severe damage to anyone or anything in its path. In addition, the placement of pressure relief holes on the bottom and top of the grenade housing for directing the explosive energy solely in a direction parallel to the longitudinal orientation of the housing may cause injury to law enforcement personnel who accidentally detonate the device while the pressure relief holes are facing the user's body.

In view of the drawbacks of prior art devices as discussed above, it is desirable to have a stun grenade incorporating safety features which eliminate the possibility of the grenade becoming a projectile when detonated, while simultaneously reducing the risk of injury to operators of such devices.

SUMMARY OF THE INVENTION

The present invention is directed to a stun grenade for use by law enforcement personnel for distracting criminal suspects prior to apprehension. In its broad sense, the invention is a stun grenade comprising a fuse, a cartridge containing an explosive charge in communication with the fuse, and a housing defining a longitudinal axis and having an internal cavity for the cartridge, the housing further defining at least one vent in fluid communication with the cavity for discharging energy released when the explosive charge is detonated, a first defining wall of the vent being angularly offset from the longitudinal axis for discharging the energy radially outwardly therefrom.

In the preferred embodiment, a first group of vents is distributed adjacent the top of the housing and a second group of vents is distributed adjacent the bottom of the housing, and a defining wall of each vent is angularly offset from the longitudinal axis for discharging energy from the cavity radially outwardly therefrom. Most preferably, the first group of vents communicates at one end with the cavity and at the other end with both a top wall and a side wall of the housing and the second group of vents communicates at one end with the cavity and at the other end with the bottom wall and side wall of the housing.

The first defining wall of the vents is preferably offset from the longitudinal axis at an angle of about 10° to 45°, with about 15° being presently preferred. Desirably, a second defining wall of each vent communicating with the side wall of the housing is substantially perpendicular to the longitudinal axis, such that in the preferred embodiment explosive energy from the cavity is discharged at the top and bottom of the stun grenade over an arc angle of about 15°–90° relative to the longitudinal axis.

The configuration and distribution of vents in accordance with the present invention minimizes the possibility that the stun grenade will be converted to a dangerous projectile, as would occur if a substantial number of the vents is obstructed as by a wall, floor, furniture, appliance, etc. Furthermore, by insuring that explosive energy from the device is radially distributed about the stun grenade, the risk of injury to law enforcement personnel is minimized. That is, in the event the device is inadvertently detonated in proximity to law enforcement personnel, radial dispersion of the explosive energy minimizes the force concentrated in any one direction thereby minimizing the possibility of injury.

In the preferred embodiment, the housing is cylindrically shaped and includes a top member, a bottom member, and a central section. The top member is secured to the central section as by crimping, though it may be releasably secured in reusable embodiments. In any event, the preferred top member is constructed as a combination fuse and port block and to this end includes an inner section projecting into the cavity for securement to the upper end of the cartridge. An opening extends through the top member communicating its top wall to the cartridge, with the upper end of the opening dimensioned for securement to a fuse, such that when the fuse is activated its flash communicates with the explosive charge in the cartridge for detonating the stun grenade. Preferably all of the vents are defined in the top member and the bottom member, both of which are separately formed and secured to the central section.

In another preferred embodiment, the stun grenade includes a centered bore in the bottom wall of the housing base for optionally securing any of a variety of attachments to the grenade. For example, a clamp having a portion configured for engagement within the bore may be attached to the grenade for securing it to an object such as a table, car bumper, etc. Alternatively, a canister containing a dispersible substance, such as tear gas powder or the like, may be secured to the grenade such that when the grenade is detonated, the explosive force breaches the canister for diffusing the dispersible substance therein.

The foregoing as well as further features and advantages of the present invention will become more fully apparent from the following detailed description and annexed drawings.

BRIEF DESCRIPTION OF THE DRAWINGS

In the drawings, wherein like reference numerals denote similar elements throughout the several views.

DETAILED DESCRIPTION OF THE PREFERRED EMBODIMENT

Figure 1:
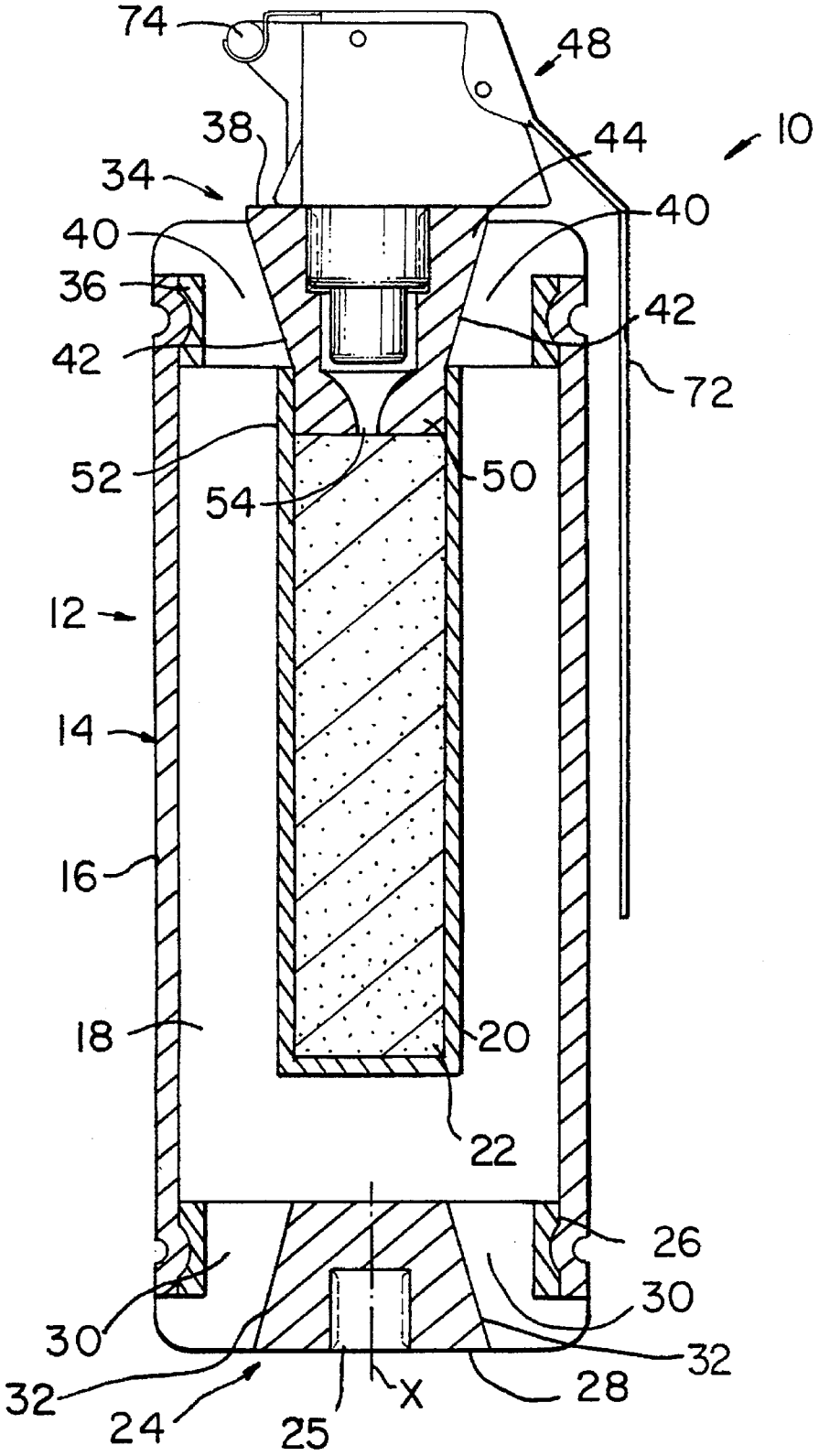
FIG. 1 is a cross-sectional view of a stun grenade in accordance with the present invention.

Referring now to the drawings and initially to FIGS. 1 and 2, a stun grenade 10 constructed in accordance with a presently preferred embodiment of the invention will now be described. As shown, the stun grenade 10 has a longitudinal axis x and comprises a housing 12 having an elongate hollow cylindrical body 14 having a side wall 16 and defining a cylindrical cavity 18 configured for receiving a cartridge 20 containing an explosive charge 22.

Referring to FIGS. 1–5, housing 12 includes a bottom end section or base 24 having a side wall 26 and bottom wall 28 secured in the bottom of body 14. Although base 24 is shown as a separate member secured to body 14 as by crimping, base 24 may be integrally formed with body 14 or otherwise secured thereto. As shown, a plurality of vents or slots 30 are formed in the base 24 for communicating cavity 18 with the environment. As explained more fully below, the vents 30 provide a path for releasing explosive energy generated upon detonation of the explosive charge 22 from the cavity 18 to the area about stun grenade 10. While ten vents 30 are depicted in the preferred embodiment illustrated in the drawings, the number of vents is not critical. The present invention contemplates at least one such vent, and preferably a plurality of such vents.

In the preferred embodiment, vents 30 communicate at one end with the cavity 18 and at the other end with the side wall 26 and bottom wall 28. As such, the plurality of vents 30 discharge explosive energy both radially through side wall 26 and in a direction angularly offset from longitudinal axis x through bottom wall 28. As shown in FIGS. 1 and 2, the radially innermost defining wall 32 of each vent 30 is angled for directing explosive energy from cavity 18 at an angle to the longitudinal axis x. Preferably the walls 32 are at about a 15° angle relative to the longitudinal axis, though other angles may be employed, with angles between about 10° and about 45° being presently preferred. In any event, the plurality of vents 30 discharge explosive energy from cavity 18 radially outwardly relative to longitudinal axis x both through side wall 26 and through bottom wall 28.

With continued reference to FIGS, 1 and 2, the stun grenade 10 also comprises a top end section or cover 34 positioned at the top of body 14 and secured thereto as by crimping. Like base 24, cover 34 has a side wall 36, a top wall 38 and defines a second plurality of slots or vents 40 communicating at one end with cavity 18 and at the other end with the side wall 36 and top wall 38. It will now be apparent that the side wall of the housing 12 is collectively defined by the side wall 16 of the body 14, the side wall 26 of the base 24 and the side wall 36 of the cover 34.

Like base 24, the radially innermost defining wall 42 of each vent 40 in cover 34 is angled for directing explosive energy released from cavity 18 at an angle relative to the longitudinal axis x. Like walls 32, the walls 42 are preferably at about a 15° angle relative to the longitudinal axis x, though other angles may also be employed, with angles between about 10° and about 45° being presently preferred. It will be apparent that vents 40 transmit explosive energy in cavity 18 for discharge radially outwardly relative to longitudinal axis x both through side wall 36 and through top wall 38.

As preferred and shown, cover 34 is configured as a combination fuse and port block wherein a center portion 44 of the cover 34 defines a central elongated opening 46 configured for receiving a fuse 48. The upper defining wall of the central elongate opening 46 is preferably threaded for receiving complementary threading on the fuse 48 for securing the latter in opening 46. As usual, fuse 48 is comprised of a fuse lever 72 and a pin 74 which, for obvious safety reasons, must be removed before the stun grenade 10 can be used.

Figure 2:
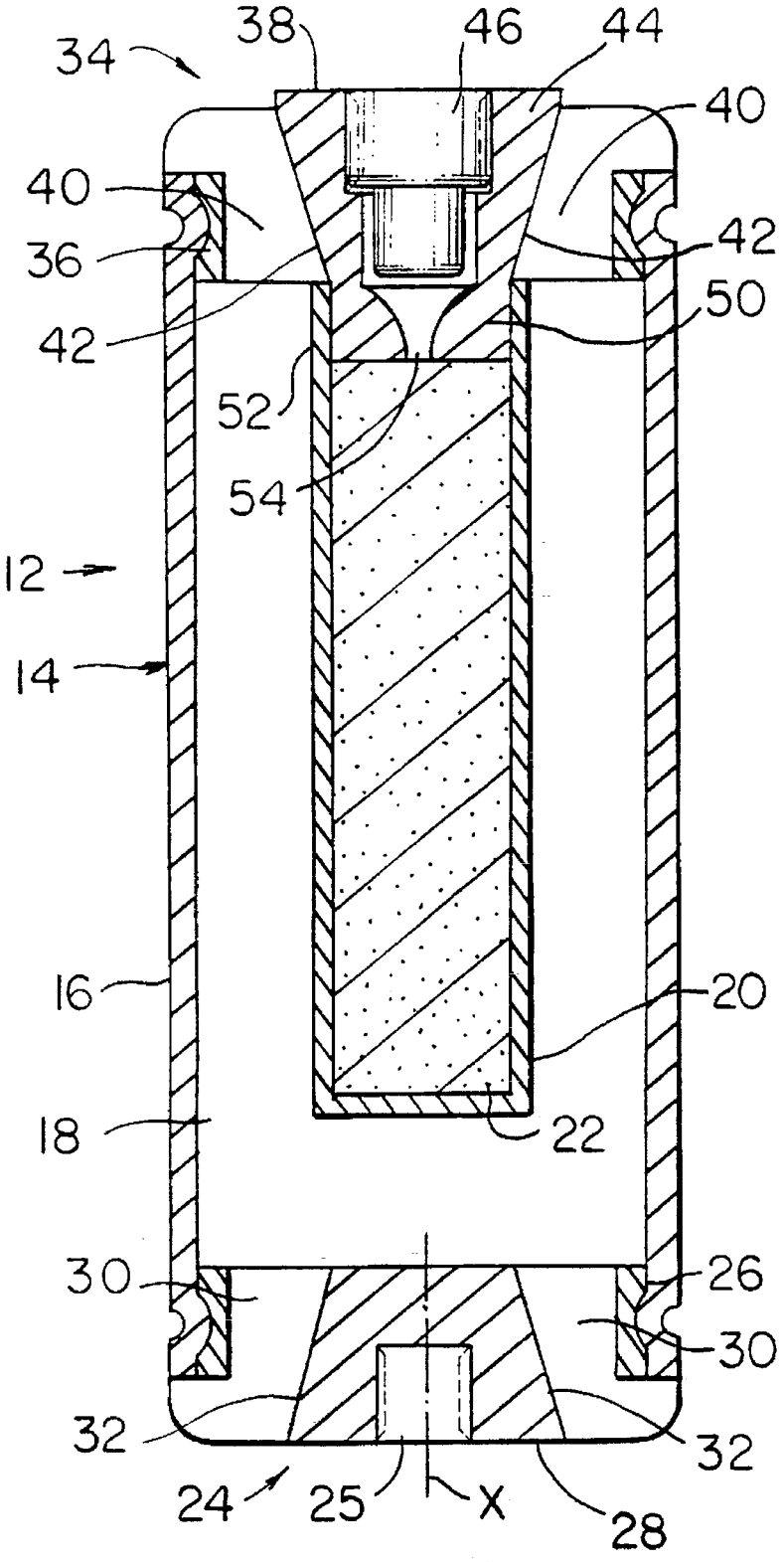
FIG. 2 is a cross-sectional view of the stun grenade of FIG. 1 with the fuse removed therefrom.

As best shown in FIGS. 1 and 2, the center portion 44 of the cover 34 has a preferably cylindrically shaped inner section 50 dimensioned for a friction fit within an opening 52 at the upper end of the cartridge 20. The lower end of the elongate opening 46, which extends through inner section 50, is tapered for defining a flash hole 54 communicating explosive charge 22 with fuse 48 thereby detonating charge 22 when device 10 is activated.

Figure 4:
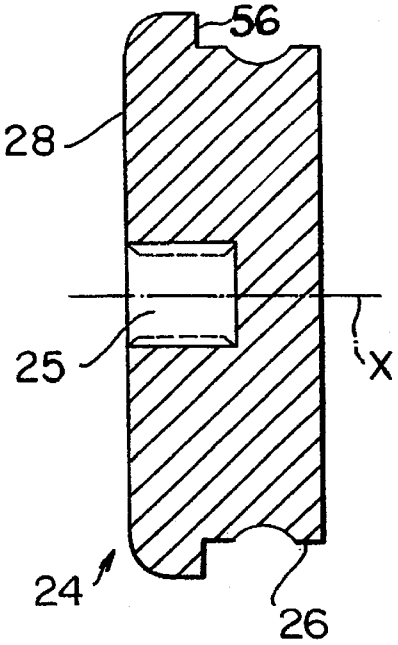
FIG. 4 is a cross-sectional view taken along the line 4—4 in FIG. 3.
Figure 3:
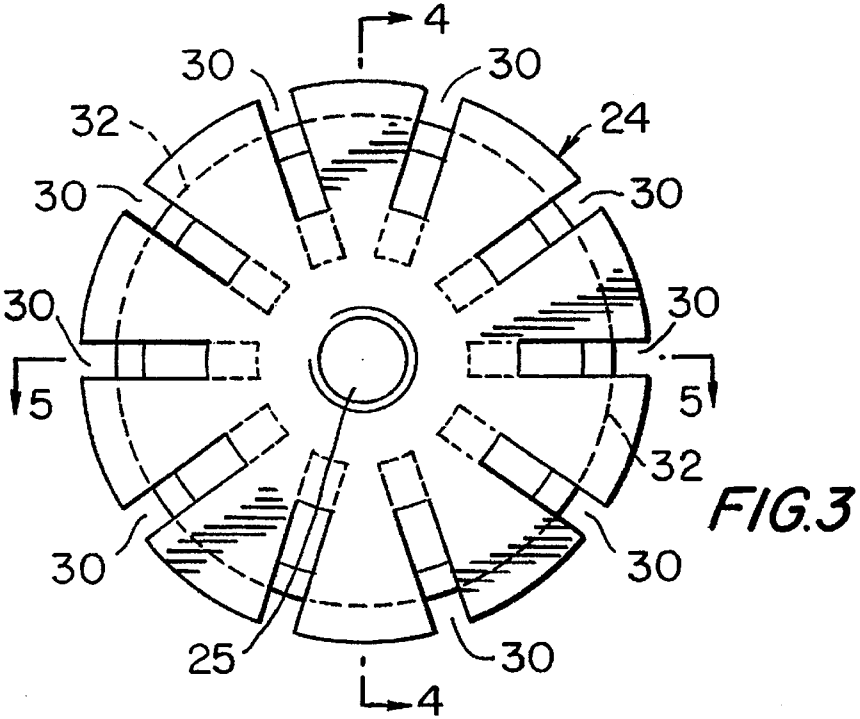
FIG. 3 is a bottom plan view of the base of the housing of a stun grenade in accordance with the present invention.
Figure 5:
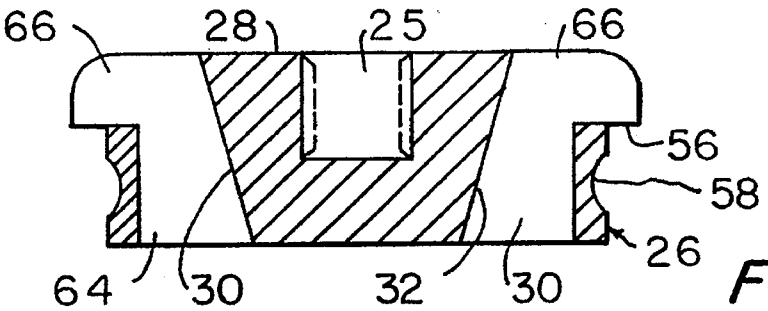
FIG. 5 is a cross-sectional view taken along the line 5—5 in FIG. 3.
Figure 3A:
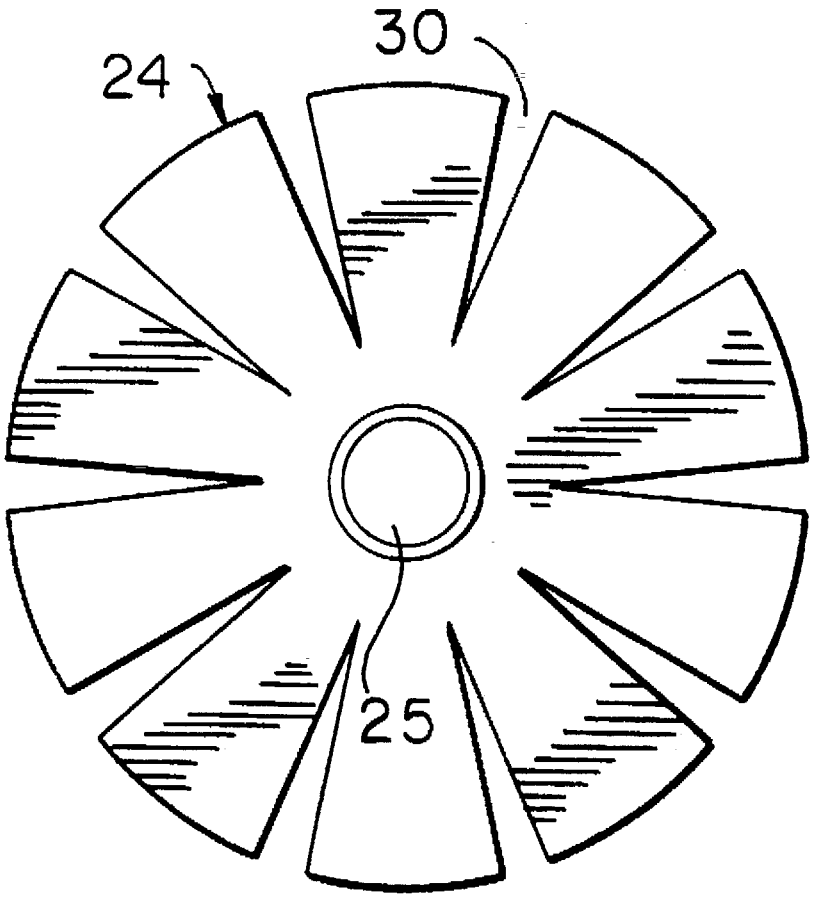
FIG. 3A is a bottom plan view of an alternate embodiment of the present invention.

Referring to FIGS. 3–5, the configuration of base 24 will now be more fully described. As best seen in FIG. 3, the vents 30 are identical and preferably of rectangular cross-section although the vents can also have a varied or tapered cross-section as shown in FIG. 3A. In the preferred embodiment, the vents 30 are radially distributed about base 24 at 36° intervals as measured between center lines. As shown in FIGS. 4 and 5, side wall 26 has a lip or shoulder 56 defining a section of reduced diameter dimensioned for a close fit in the bottom end of body 14, with lip 56 seating against the bottom edge of the body. As stated above, base 24 may be integrally formed with body 14 or secured thereto in any known manner, such as by soldering, though crimping is presently preferred and for this purpose a circumferential indent or crimp 58 is provided in side wall 26.

Figure 6:
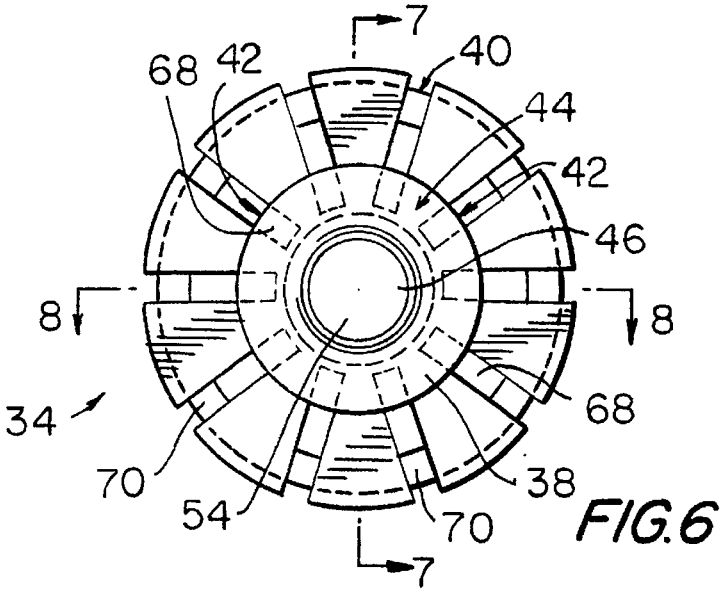
FIG. 6 is a top plan view of the top of the housing of a stun grenade in accordance with the present invention.
Figure 7:
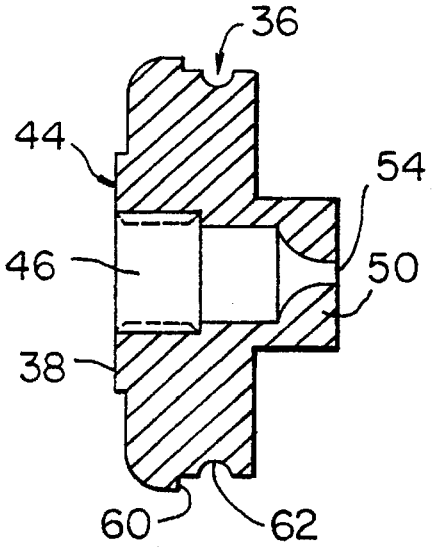
FIG. 7 is a cross-sectional view taken along line 7—7 in FIG. 6.
Figure 8:
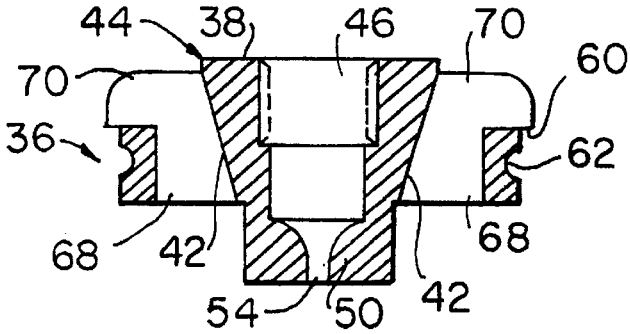
FIG. 8 is a cross-sectional view taken along the line 8—8 in FIG. 6.

With reference to FIGS. 6–8, the vents 40 in top end section 34 are also identical and preferably of rectangular cross-section. Ten such vents 40 are preferred and, like vents 30, they are radially distributed about top section 34 at 36° intervals as measured between center lines. Top section 34 is secured to body 14 in a manner similar to that employed for securing base 24 to body 14. That is, top section 34 includes a recessed portion defined by a shoulder 60, the recessed portion being dimensioned for a close fit in the top end of body 14 with lip 60 seating against the top edge of the body. Like base 24, cover 34 may be secured to body 14 in any known manner, but it too is preferably secured by crimping, and to this end cover 34 preferably includes an annular recess or crimp 62.

As best seen in FIGS. 3 and 5, each vent 30 includes a first portion 64 communicating with cavity 18 and an enlarged second portion 66 communicating with side wall 26 and bottom wall 28. The first portion 64, being partially defined by angled wall 32, has a gradually decreasing cross-section proceeding in a direction from cavity 18 to second vent portion 66. As is now apparent, the enlarged vent portion 66 communicates energy discharged from cavity 18 radially outwardly both through side wall 26 and bottom wall 28.

Referring now to FIGS. 6 and 8, like base 24, each vent 40 in cover 34 includes a first, tapered portion 68 communicating with cavity 18 and an enlarged second portion 70 communicating with side wall 36 and top wall 38. Like vents 30, vents 40 discharge explosive energy from cavity 18 radially outwardly both through side wall 36 and top wall 38.

In the preferred embodiment, the housing 12 is cylindrically shaped and comprised of a resilient steel, such as grade 1020 standard mechanical tubing. Typically, housing 12 may have an outer diameter of 2.0 inches and a length of 4.7 inches. Side wall 16 may have a thickness of 0.125 inches. The central elongated opening 46 may have a diameter of 1.875 inches and extend approximately 0.350 inches downward relative to top wall 38.

To use the stun grenade 10, pin 74 is removed and lever 72 is depressed against the body 14. The device is then thrown toward an intended target, such as a window. Once released, the lever 72 returns to its original position thereby activating fuse 48 which ignites a flash charge after a delay of approximately 1.5 to 2 seconds. When the flash charge is ignited, a spark is directed through the flash hole 54 in communication with the explosive charge 22 in cartridge 20, thereby igniting the explosive charge and causing an explosion.

When the explosion occurs, the resultant energy is released relatively evenly through the plurality of vents 30, 40, assuming, of course, that the vents are unobstructed. Owing to the configuration and placement of vents 30, 40, the explosive energy is vented at the top and bottom of stun grenade 10 with an angular distribution of between about 15° and about 90° relative to longitudinal axis x.

As will now be appreciated, providing vents 30, 40 configured to direct the explosive energy over an arc angle of about 15° to about 90° relative to the longitudinal axis x enhances the operational safety of the device 10. For example, when the device 10 is thrown inside a room, it is unlikely that sufficient ones of the vents 30, 40 will be obstructed by a wall, floor, etc. to convert device 10 to a dangerous projectile. Even in the unlikely event that both the bottom vents 30 and top vents 40 are obstructed at the same time as by a wall, floor, furniture, appliance, etc., device 10 would still not assume the character of a projectile, for it is a virtual certainty that bottom wall 28, top wall 38 and side walls 26 and 36 will never be simultaneously obstructed. Yet that would have to be the case if the safety of the device 10 were to be seriously compromised. Even if one end wall of the device 10 rests squarely against a wall or other surface, venting at that end will not be completely obstructed, but rather will still be accommodated through the side wall at the obstructed end. This, of course, is a direct benefit of vents 30, 40 that communicate not only with bottom wall 28 and top wall 38, respectively, but side walls 26 and 36 as well.

It should also now be appreciated that if the device 10 inadvertently detonates while being held, it will likely cause less injury than prior art devices. For example, in prior art devices wherein the holes extending through the base and cover are parallel to the longitudinal axis, all of the explosive energy is concentrated along that axis. Consequently, if the device is held under the user's head or facing the chest, all of the explosive energy will be directed toward that part of the body. In the device 10, on the other hand, the vents 30 and 40 direct explosive energy from cavity 18 radially outwardly relative to longitudinal axis x. Consequently, the explosive energy is not concentrated in any particular direction. Indeed, the further one is from the device 10, the more diffuse is the explosive energy released from cavity 18.

It is an aspect of the present invention that a portion of the explosive energy in the cavity 18 is discharged via vents through the side wall of the housing 12. In the embodiment shown, this discharge occurs through the side walls of base 24 and cover 34. Although preferred, that is not necessary, and in other embodiments discharge may be through the side wall 16 of the body 14.

In the preferred embodiment described hereinabove, the vents 30, 40 each communicate at one end with cavity 18 and at the other end with the side wall and one end wall of the housing 12. While this too is preferred, it is not mandatory. All that is necessary is that at least some, and preferably all, of the energy discharged from the cavity 18 upon detonation of the explosive charge 22 is discharged radially outwardly relative to longitudinal axis x. Venting of the housing 12 to achieve this objective may be accomplished in a variety of ways.

Figure 9A:
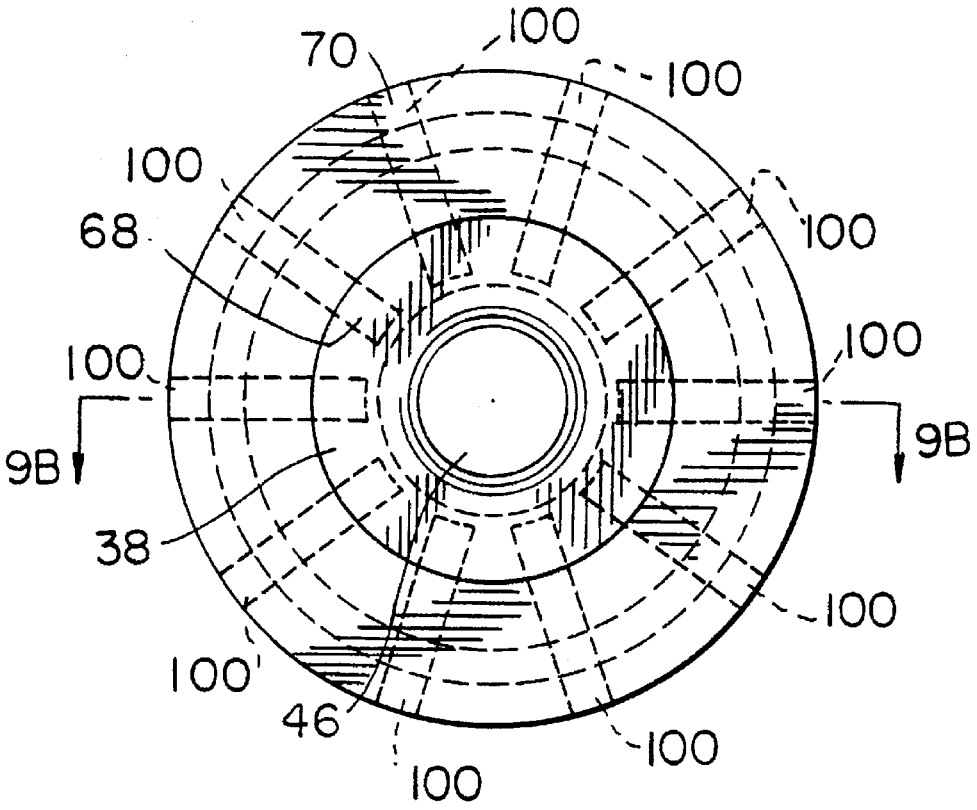
FIG. 9A is a view similar to FIG. 6 and showing an alternative venting configuration.
Figure 9B:
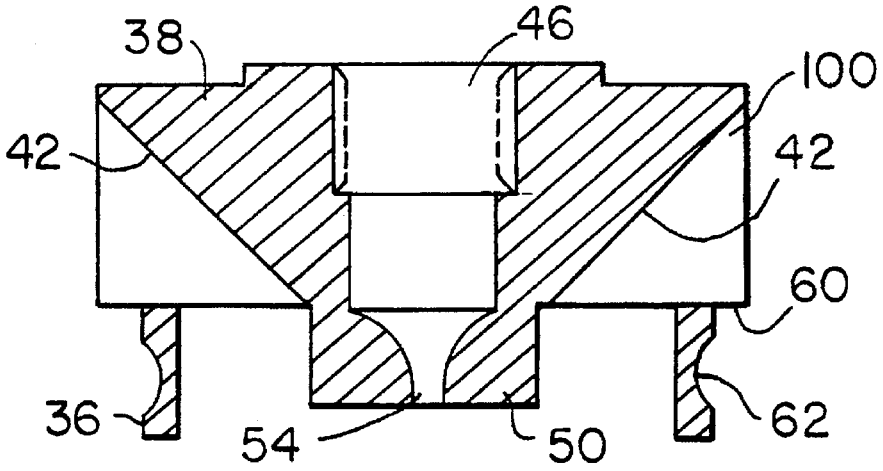
FIG. 9B is a view similar to FIG. 8 for the case of the venting configuration of FIG. 9A.

For example, referring initially to FIGS. 9A and 9B, an alternative configuration of vents 100 for discharging explosive energy from cavity 18 radially outwardly through cover 34 is shown. While the vents 100 depicted in FIGS. 9A and 9B are of uniform cross-section, that is not necessary, and the vents 100 may, for example, widen or narrow gradually, stepwise or otherwise proceeding in the direction from the cavity 18 to the side wall 36. To avoid body 14 occluding vents 100, the side wall 36 has been extended downward as compared with the FIG. 5 embodiment and the crimp 62 is now located on the extended portion. The base 24 may be provided with a venting configuration similar to that depicted in FIGS. 9A and 9B or, alternatively, any of the other venting configurations described herein.

Figure 10A:
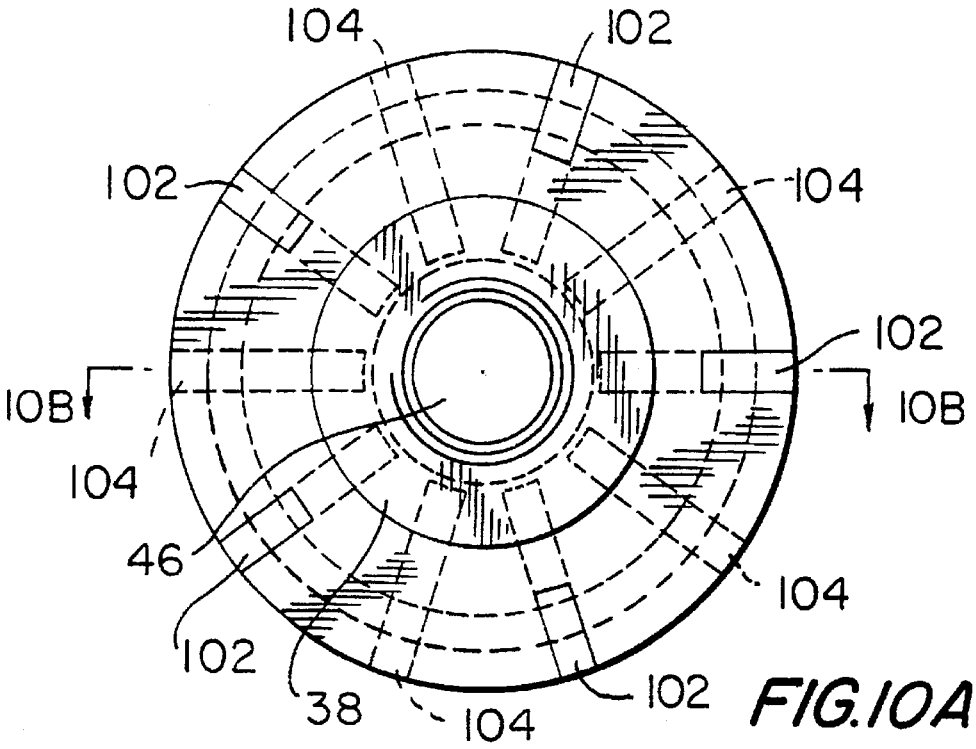
FIG. 10A is a view similar to FIG. 6 and showing a further alternative venting configuration.
Figure 10B:
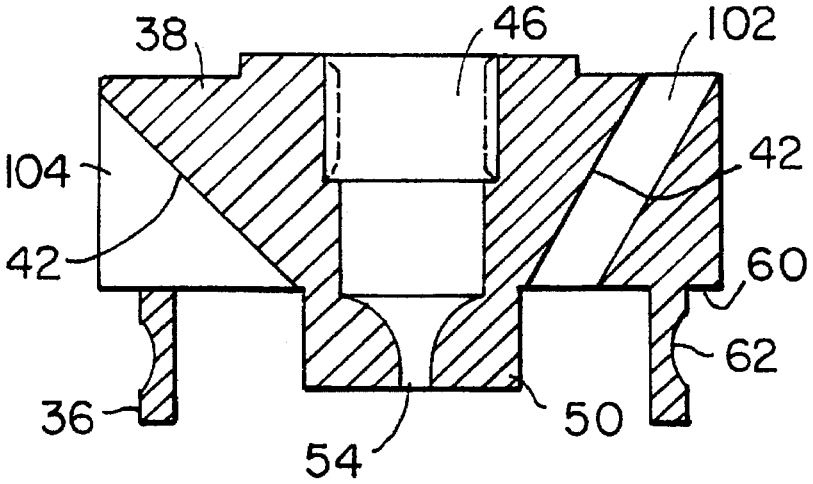
FIG. 10B is a view similar to FIG. 8 for the case of the venting configuration of FIG. 10A.

Referring next to FIGS. 10A and 10B, another venting configuration is illustrated. This embodiment comprises alternating vents 102, 104 distributed radially about the cover 34, with a first group of vents 102 communicating with top wall 38 and a second group of vents 104 communicating with side wall 36. Again, while the cross section of the vents 102, 104 is shown as uniform, this is not mandatory. Nor is the specific angle at which the vents 102, 104 are oriented relative to the longitudinal axis x. Like the embodiment shown in FIGS. 9A and 9B, and for the same reason, side wall 36 is extended downward and crimp 62 is located on the extended portion. As is true of all the embodiments described herein, the base 24 may be provided with a similar venting configuration or, alternatively, any of the other venting configurations described herein or combinations and variations thereof.

Figure 11A:
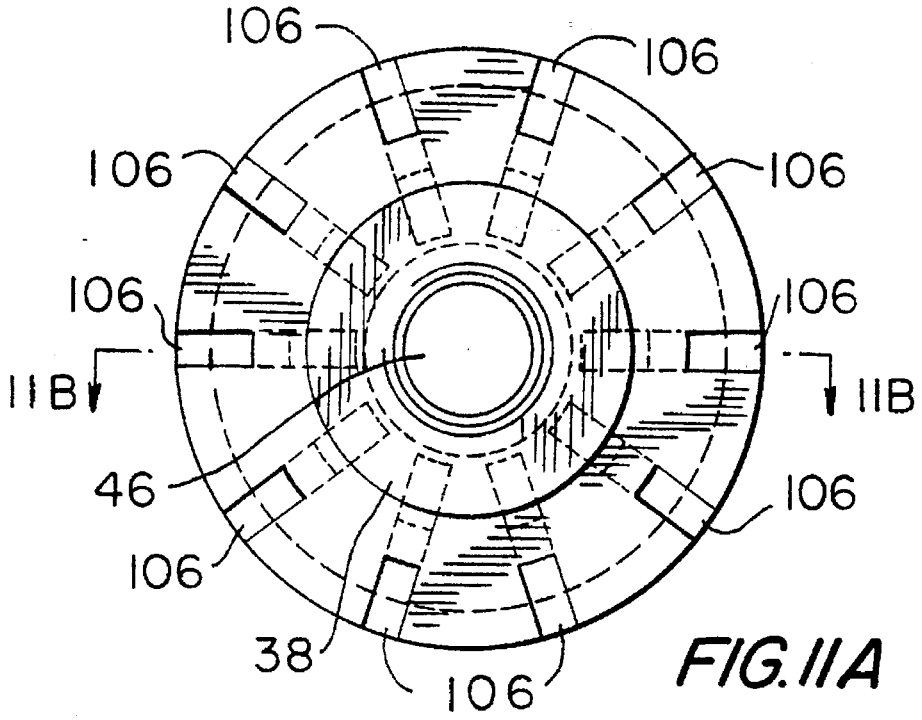
FIG. 11A is a view similar to FIG. 6 and showing yet another alternative venting configuration.
Figure 11B:
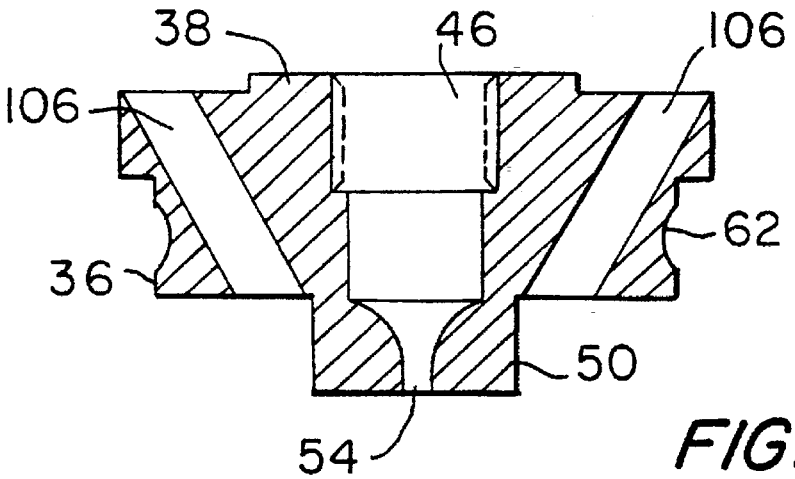
FIG. 11B is a view similar to FIG. 8 for the case of the venting configuration of FIG. 11A.

Referring now to FIGS. 11A and 11B, yet another venting configuration is depicted. As shown, in this embodiment vents 106 are distributed radially about the cover 34 and communicate cavity 18 with top wall 38. In this embodiment there are no vents formed in the side wall for venting directly to the side of the housing 12. It will be appreciated, however, that because the vents 106 are angled, explosive energy released from cavity 18 is discharged radially outwardly relative to the longitudinal axis x.

As yet a further alternative, the fuse 48 may be replaced with an electrical initiator securable within the opening 46 for accommodating remote detonation of the grenade 10. For example, a remotely activatable grenade 10 may be secretly placed in a vacant room for detonation at a later time.

Figure 12A:
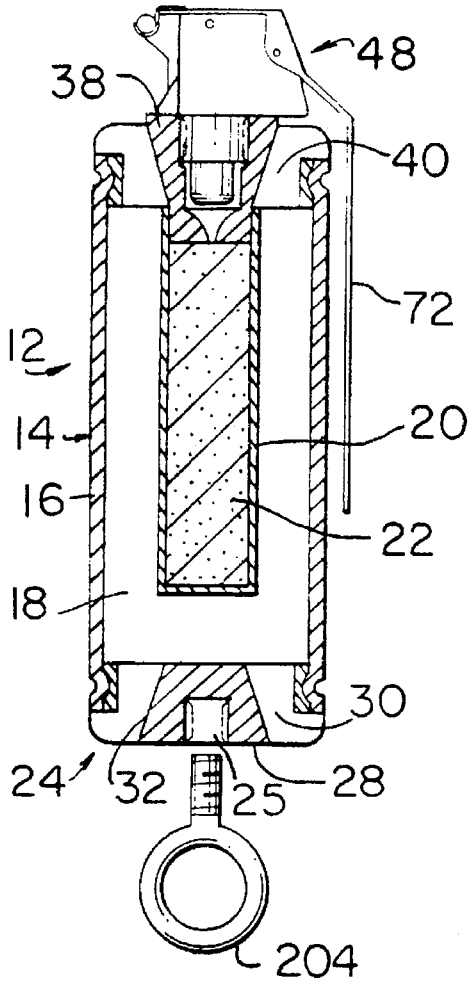
FIGS. 12A–12C are views similar to FIG. 1 showing the stun grenade of the invention with various attachments connected to the base thereof.
Figure 12B:
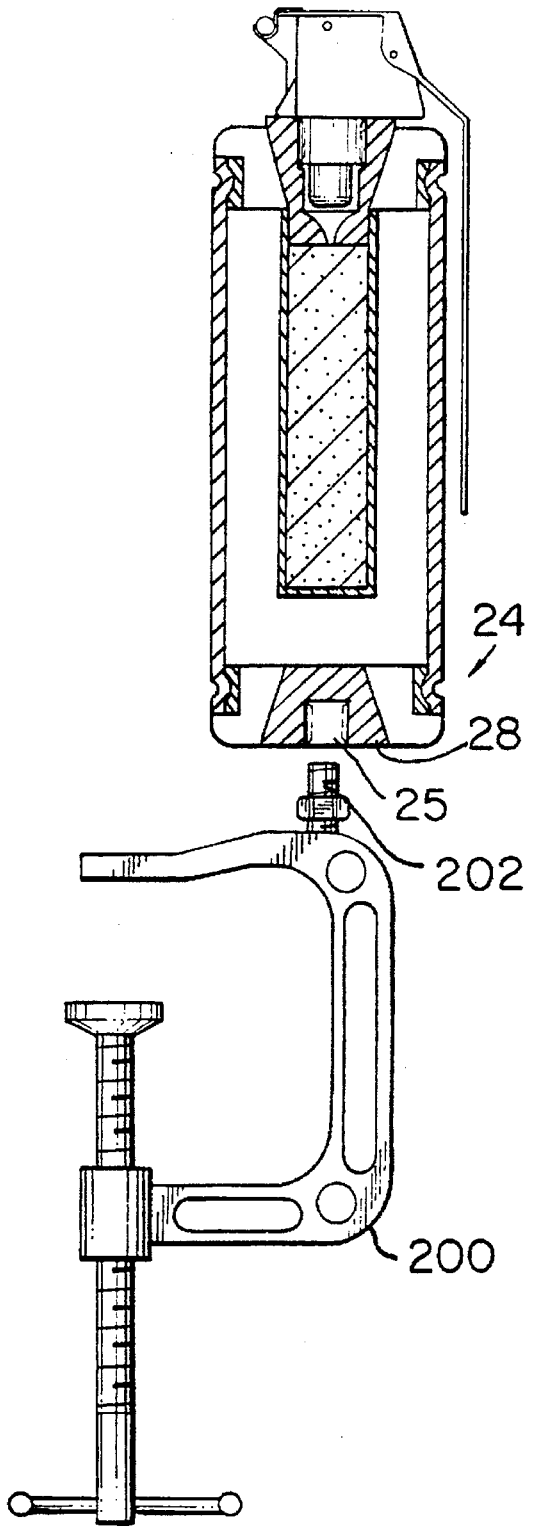
Figure 12C:
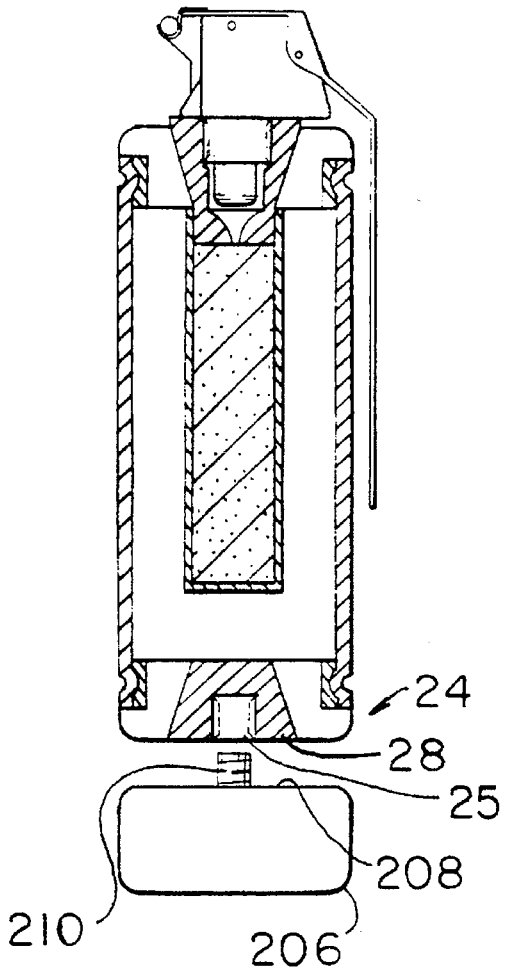

Referring lastly to FIGS. 12A–12C, the preferred embodiment of the stun grenade 10 also includes a securing means comprising a centered bore 25 in the bottom wall 28 of base 24 which serves to optionally secure a variety of attachments to the grenade 10. For example, a clamp 200 (FIG. 12B) having an external member 202 may be secured in the bore 25 such that grenade 10 may be secured to a table, chair, car bumper, etc., for booby trapping or remote operation. The bore 25 can also receive an eyebolt 204 (FIG. 12A), to which a rope or the like may be secured, whereby the grenade 10 may be swung through a window, as from an upper floor. Alternatively, a tear gas canister 206 (FIG. 12C) having a frangible wall 208 and a diameter matching that of body 14 may be secured in bore 25 as by an external member 210 at one end such that explosive energy released through bottom vents 30 perforates the frangible wall 208 thereby dispensing the powder therein. Still other attachments will suggest themselves to those skilled in the art who have read this description.

Figure 12D:
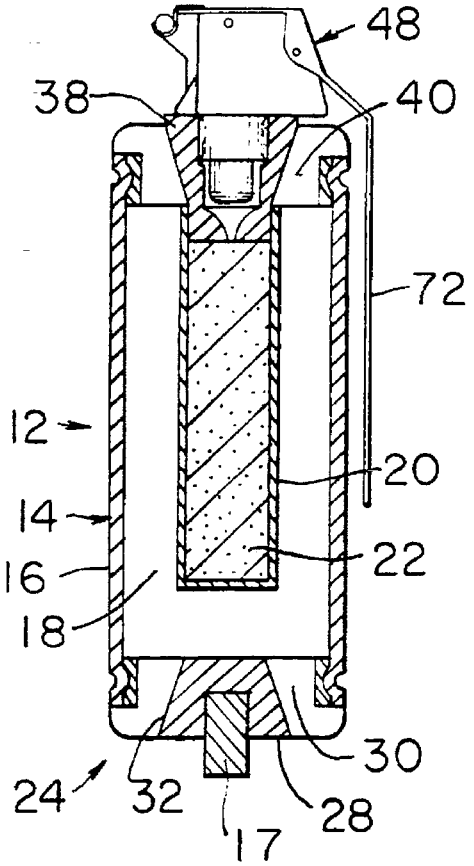
FIG. 12D is a view similar to the stun grenade of FIG. 1 with a protrusion attached to the base thereof for securing the grenade to various attachments.

Although bore 25 is preferably threaded to releasably engage with threading on external members on the attachments, other securing means may be employed without falling outside the scope of the present invention. For example, a bayonet type securing arrangement can be used wherein the external member of an attachment is inserted into bore 25 and twisted to lock the attachment in place, thereby securing it to the grenade housing 12. While for purposes of stability—such as positioning the grenade 10 in an upright position on a flat surface —the securing means is preferably comprised of the bore 25 defined in the bottom wall 28 of base 24, the securing means may alternatively comprise a protrusion 17 extending from bottom wall 28 for engagement with a recess or bore in the attachment as shown in FIG. 12D. Still other securing means will be apparent to those having ordinary skill in the art and applicant's invention is intended to encompass all such alternatives as equivalents to the securing means described herein.

Although I have herein shown and described the currently preferred embodiment of the invention, and suggested certain modifications thereto, still other changes and modifications may be made therein without departing from the spirit and scope of the present invention. For example, as opposed to a cylindrically shaped construction, other body shapes such, as a football-type shape, may be employed without departing from the invention. In addition, although vents 30 and 40 are depicted as having uniform cross-sectional areas, this need not be the case and the vents can, instead, be tapered or one end of the vents can have a larger cross-sectional area than the cross-sectional area of the other end (as shown in FIG. 3A.) It should also be understood that the figures are not necessarily drawn to scale but are merely conceptual in nature. It will be appreciated, therefore, that the description of the preferred embodiments is for illustrative purposes only and is not to be construed as limiting the scope of the present invention, which is properly delineated only in the appended claims.

What is claimed is:

1. A stun grenade comprising:

a fuse;

a cartridge containing an explosive charge in communication with said fuse;

a housing defining a longitudinal axis and an internal cavity for said cartridge;

an end member attached to one end of said housing and having an end wall and a side wall; and a plurality of vents defined in said end member, at least some of said vents having a first defining wall angularly offset from said longitudinal axis, said at least some of said vents having one end in fluid communication with said cavity and another end in fluid communication with said end wall and said side wall for discharging explosive energy from said housing when said explosive charge is detonated.

2. The stun grenade of claim 1, wherein said end member comprises a bottom member affixed to one end of said housing.

3. The stun grenade of claim 1, wherein said end member comprises a top member affixed to one end of said housing.

4. The stun grenade of claim 2, further comprising a top member affixed to another end of said housing, said top member having an end wall, a side wall and a lower end secured to said cartridge and defining an opening therein communicating with said explosive charge and an upper end for receiving said fuse, said top member defining a plurality of vents, at least some of said vents having a first defining wall angularly offset from said longitudinal axis, said at least some of said vents having one end in fluid communication with said cavity and another end in fluid communication with said top member end wall and said top member side wall.

5. The stun grenade of claim 1 wherein said end member is attached to said housing by crimping.

6. The stun grenade of claim 4 wherein at least one of said members is attached to said housing by crimping.

7. The stun grenade of claim 1, further comprising a container and a means for releasably securing said container to said end member, said container housing a diffusible substance and having a frangible wall confronting at least some of said vents, said frangible wall being breached by a force generated when said explosive charge is detonated for dispersing said substance.

8. The stun grenade of claim 7, wherein said substance is tear gas powder.

* * * * *